US009758227B2

(12) United States Patent
Schmidtke

(10) Patent No.: US 9,758,227 B2
(45) Date of Patent: Sep. 12, 2017

(54) TROLLING MOTOR SYSTEM FOR A LIGHT-WEIGHT WATERCRAFT

(71) Applicant: Mark A. Schmidtke, Charlotte, NC (US)

(72) Inventor: Mark A. Schmidtke, Charlotte, NC (US)

( * ) Notice: Subject to any disclaimer, the term of this patent is extended or adjusted under 35 U.S.C. 154(b) by 0 days.

(21) Appl. No.: 15/265,990

(22) Filed: Sep. 15, 2016

(65) Prior Publication Data

US 2017/0001698 A1 Jan. 5, 2017

Related U.S. Application Data

(63) Continuation-in-part of application No. 14/791,926, filed on Jul. 6, 2015, now Pat. No. 9,567,051, which is a continuation-in-part of application No. 14/556,725, filed on Dec. 1, 2014, now Pat. No. 9,290,251.

(51) Int. Cl.

| | |
|---|---|
| ***B63H 20/00*** | (2006.01) |
| ***B63H 21/17*** | (2006.01) |
| ***B63H 25/38*** | (2006.01) |
| ***B63H 20/10*** | (2006.01) |
| ***B63H 20/06*** | (2006.01) |
| ***B63H 23/24*** | (2006.01) |
| ***B63H 20/08*** | (2006.01) |

(52) U.S. Cl.

CPC ..... *B63H 20/007* (2013.01); *B63H 20/06* (2013.01); *B63H 20/08* (2013.01); *B63H 20/10* (2013.01); *B63H 21/17* (2013.01); *B63H 21/26* (2013.01); *B63H 23/24* (2013.01); *B63H 25/38* (2013.01); *B63B 2755/00* (2013.01)

(58) Field of Classification Search

CPC ..... B63H 20/00; B63H 20/06; B63H 20/08; B63H 20/007; B63H 21/26; B63H 23/24; B63H 21/17; B63H 25/38; B63H 20/10

USPC ..... 440/6, 53, 55, 62; 248/640, 642

See application file for complete search history.

(56) References Cited

U.S. PATENT DOCUMENTS

| | | | |
|---|---|---|---|
| 2,923,269 | A | 2/1960 | Hoyt |
| 3,008,444 | A | 11/1961 | Bovy |
| 3,062,175 | A | 11/1962 | Mitchell |
| 3,245,640 | A | 4/1966 | Ibbs |
| 3,601,344 | A | 8/1971 | Nourse |
| 3,604,674 | A | 9/1971 | Wilkerson |
| 3,629,885 | A | 12/1971 | Jackson |
| 3,941,072 | A | 3/1976 | Caton et al. |
| 3,948,472 | A | 4/1976 | Metcalf |

(Continued)

*Primary Examiner* — Lars A Olson

(74) *Attorney, Agent, or Firm* — Hammer & Associates, P.C.

(57) ABSTRACT

A trolling motor system for a light-weight watercraft comprises: a mounting system attaches to the watercraft, the mounting system includes a bracket and a plate, the plate includes a first end, a moveable end, and a hinge therebetween, a connector removably joins the bracket to the watercraft, a pivot connects the bracket to the first end of the plate; a winch is located adjacent the first end and is adapted to raise and lower the movable end between an up position and a down position; a guidance mechanism is coupled to and below the moveable end, the guidance mechanism includes a wire system for controlling rotational movement of the trolling motor; and a trolling motor affixed to and located below the guidance mechanism.

11 Claims, 10 Drawing Sheets

(56) References Cited

U.S. PATENT DOCUMENTS

| | | | | |
|---|---|---|---|---|
| 3,965,844 | A | 6/1976 | Brock et al. | |
| 4,033,530 | A | 7/1977 | Harris | |
| 4,410,161 | A | 10/1983 | Booty | |
| 4,708,670 | A | 11/1987 | Peters | |
| 4,819,905 | A | 4/1989 | McCain | |
| 5,137,249 | A | 8/1992 | Royster | |
| 6,378,833 | B1 | 4/2002 | Ries | |
| 9,290,251 | B1 | 3/2016 | Schmidtke | |
| 9,567,051 | B2 * | 2/2017 | Schmidtke | B63H 20/08 |
| 2015/0140877 | A1 | 5/2015 | Shields | |

* cited by examiner

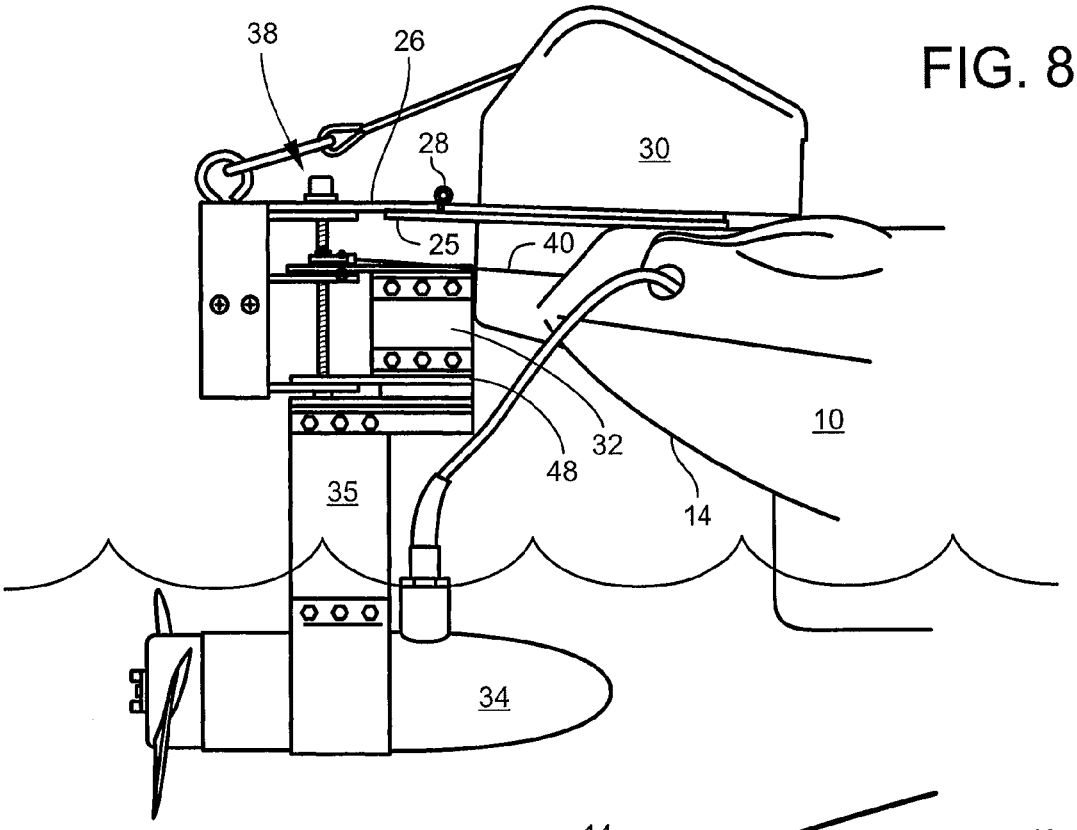
FIG. 8
FIG. 9
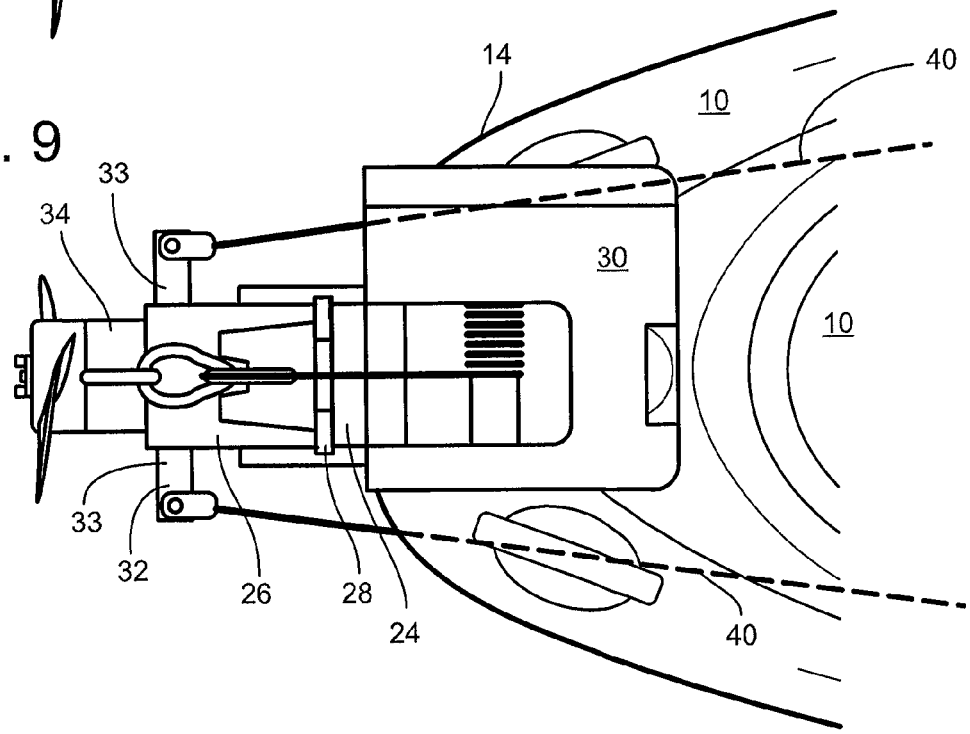

TROLLING MOTOR SYSTEM FOR A LIGHT-WEIGHT WATERCRAFT

RELATED APPLICATIONS

This application is a continuation-in-part and claims the benefit of U.S. patent application Ser. No. 14/791,926 filed Jul. 6, 2015 which is a continuation-in-part of U.S. patent application Ser. No. 14/556,725 filed Dec. 1, 2014, now U.S. Pat. No. 9,290,251, both are incorporated herein by reference.

FIELD OF THE INVENTION

The instant invention is directed to a trolling motor system for a light-weight watercraft, such as a kayak or a canoe.

BACKGROUND OF THE INVENTION

Light-weight watercraft include kayaks and canoes. Kayaks and canoes are most often self-propelled, for example by paddles. But, some outdoor enthusiasts see a need for a motor system for propelling their kayak/canoe. Use of a motor on such light-weight watercraft requires special considerations, for example, management while on the water.

The instant invention solves the issues arising from the placement of a motor system on a light-weight water craft.

SUMMARY OF THE INVENTION

A trolling motor system for a light-weight watercraft comprises: a mounting system attaches to the watercraft, the mounting system includes a bracket and a plate, the plate includes a first end, a moveable end, and a hinge therebetween, a connector removably joins the bracket to the watercraft, a pivot connects the bracket to the first end of the plate; a winch is located adjacent the first end and is adapted to raise and lower the movable end between an up position and a down position; a guidance mechanism is coupled to and below the moveable end, the guidance mechanism includes a wire system for controlling rotational movement of the trolling motor; and a trolling motor affixed to and located below the guidance mechanism.

DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 8 is a partial view of the watercraft with the motor system in an down position.

FIG. 9 is a partial view of the watercraft with the motor system where the motor is angled for dead ahead movement.

DESCRIPTION OF THE INVENTION

U.S. Pat. No. 9,290,251 and U.S. patent application Ser. No. 14/791,926 filed Jul. 6, 2015 are incorporated herein by reference.

Figure 1:
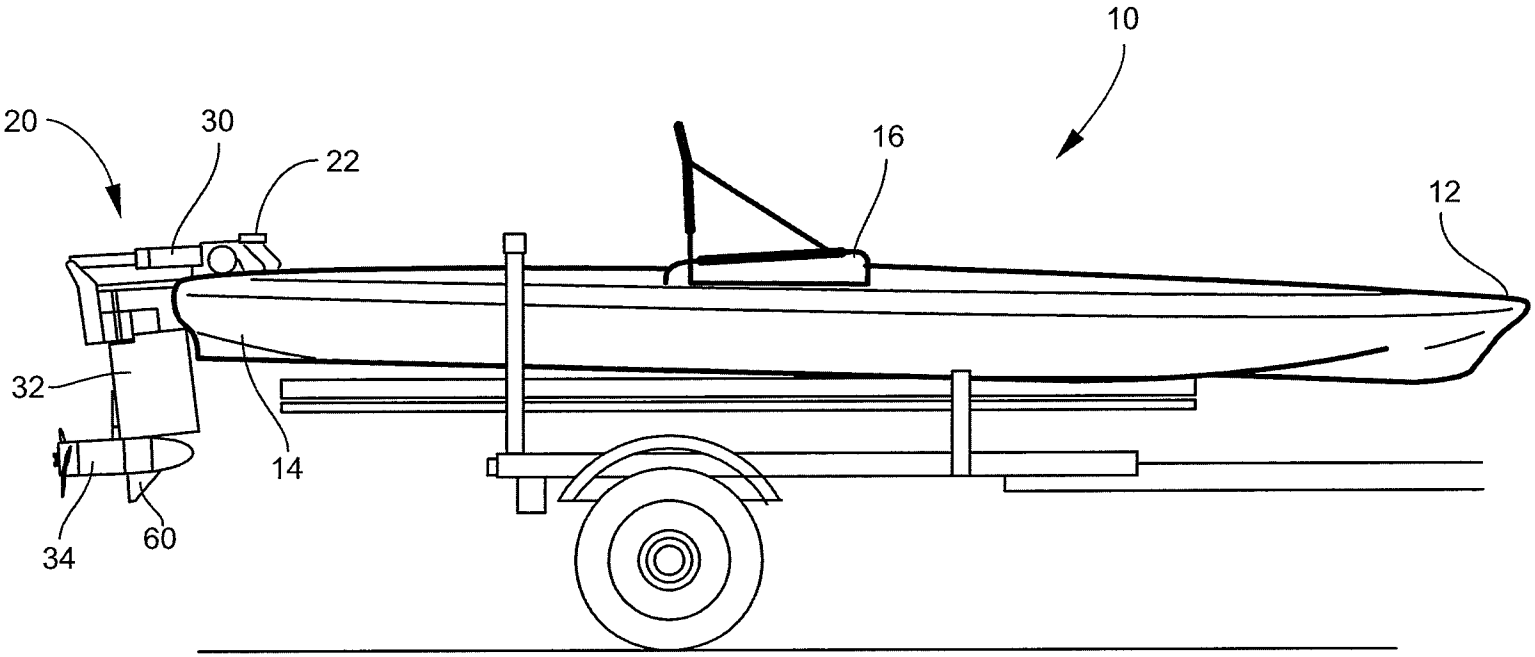
FIG. 1 is a side elevation view of a watercraft with the inventive motor system attached.
Figure 2:
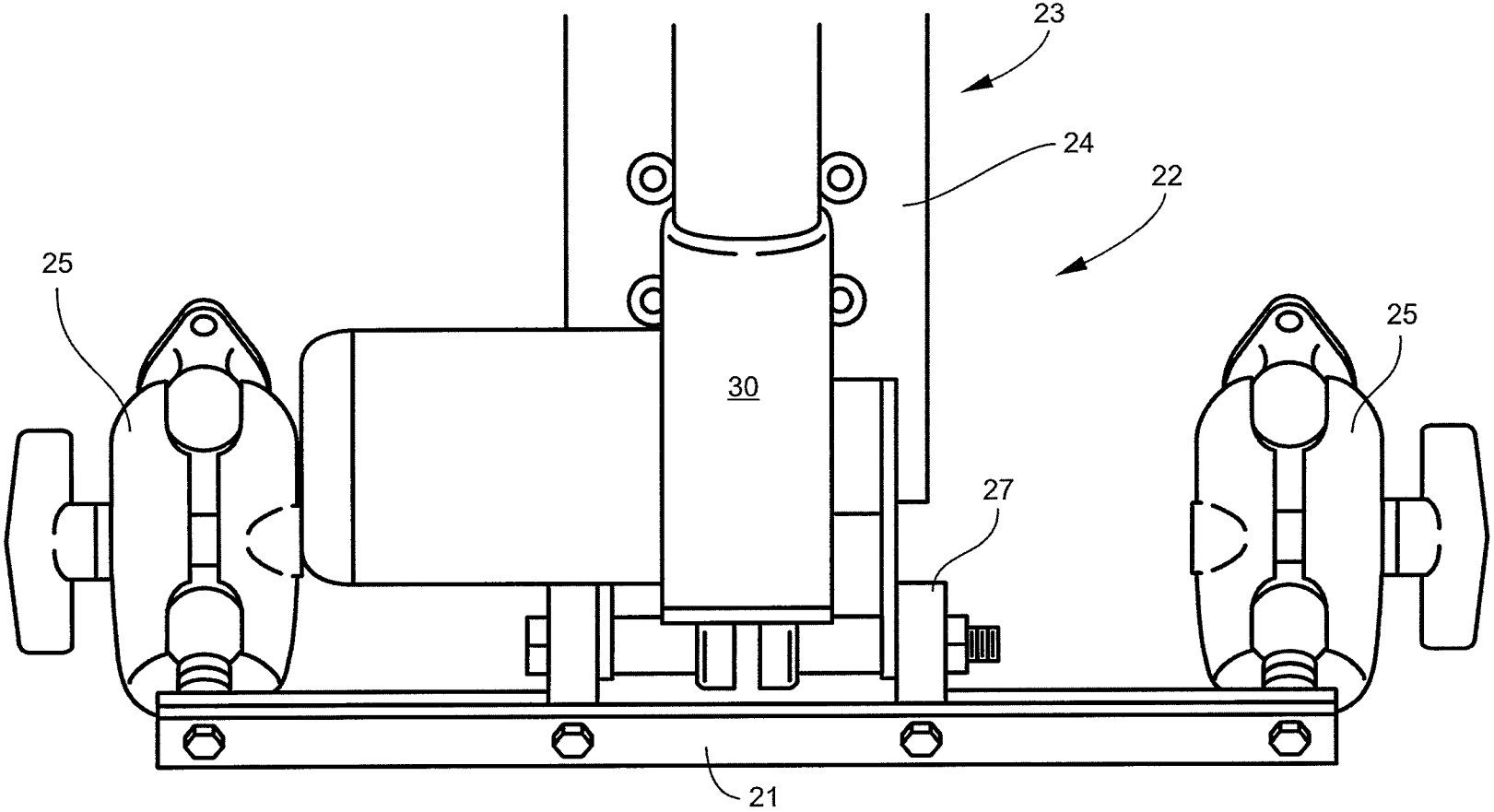
FIG. 2 is a top view illustrating the mounting system.
Figure 3:
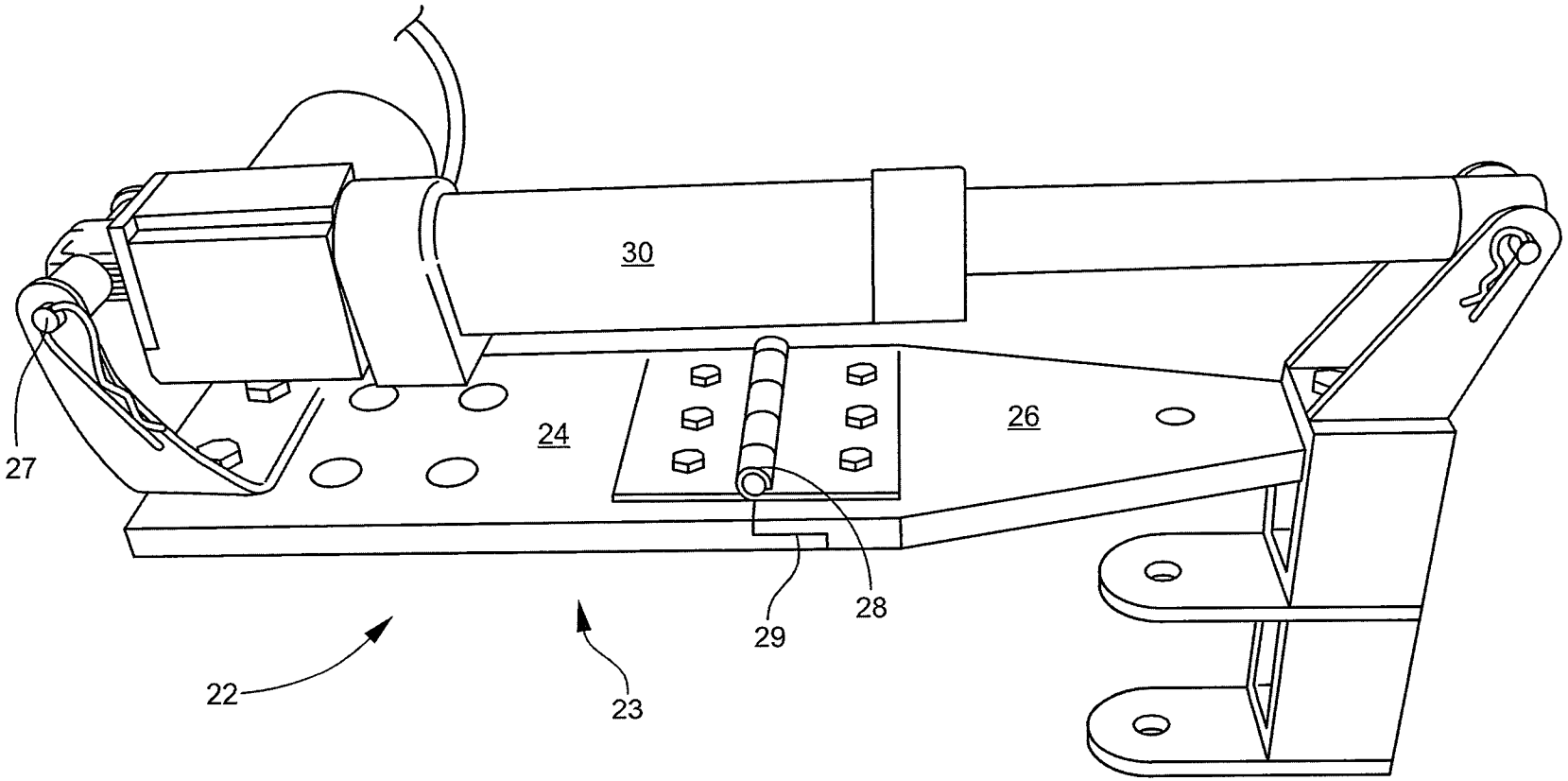
FIG. 3 is a side elevational view illustrating the mounting system.
Figure 4:
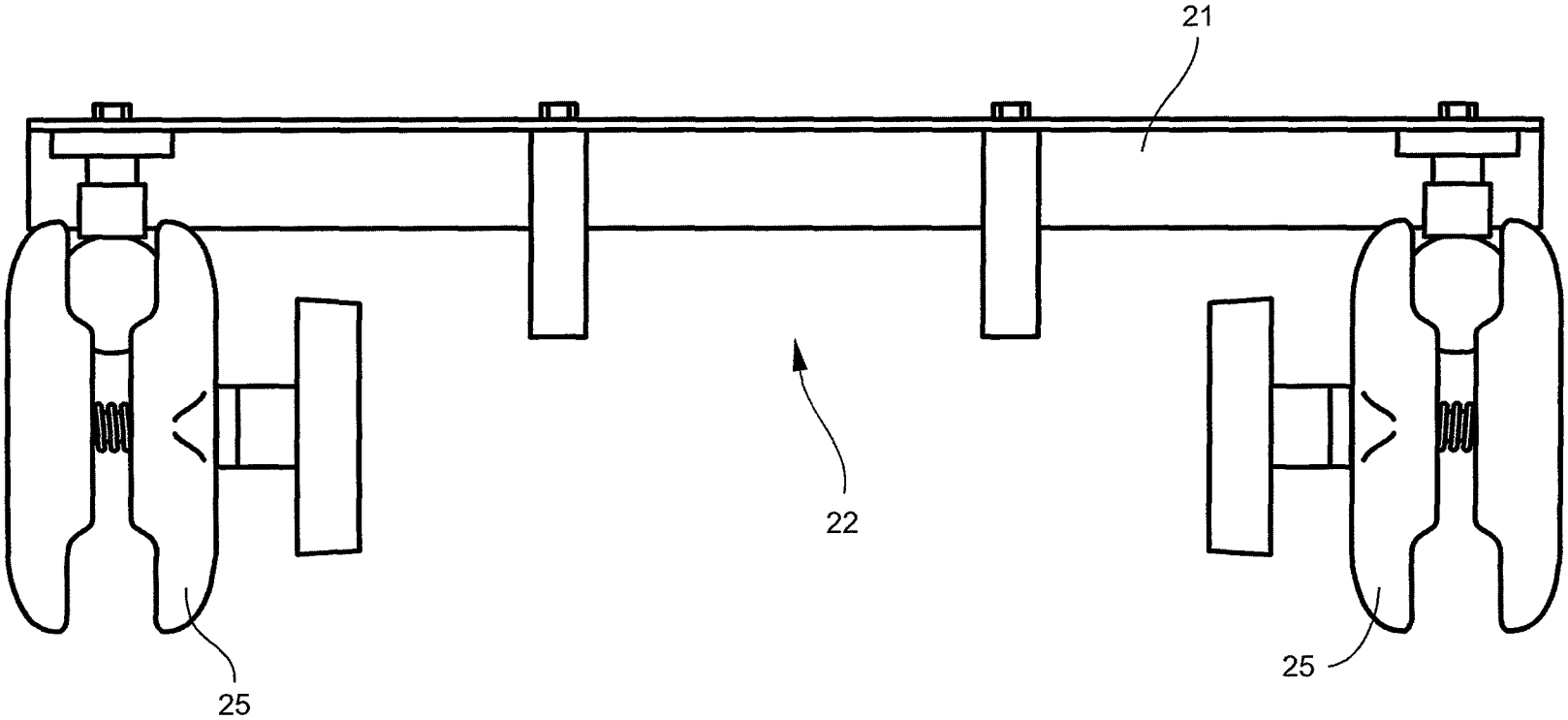
FIG. 4 is another side elevational view of the mounting system (parts not shown).
Figure 5:
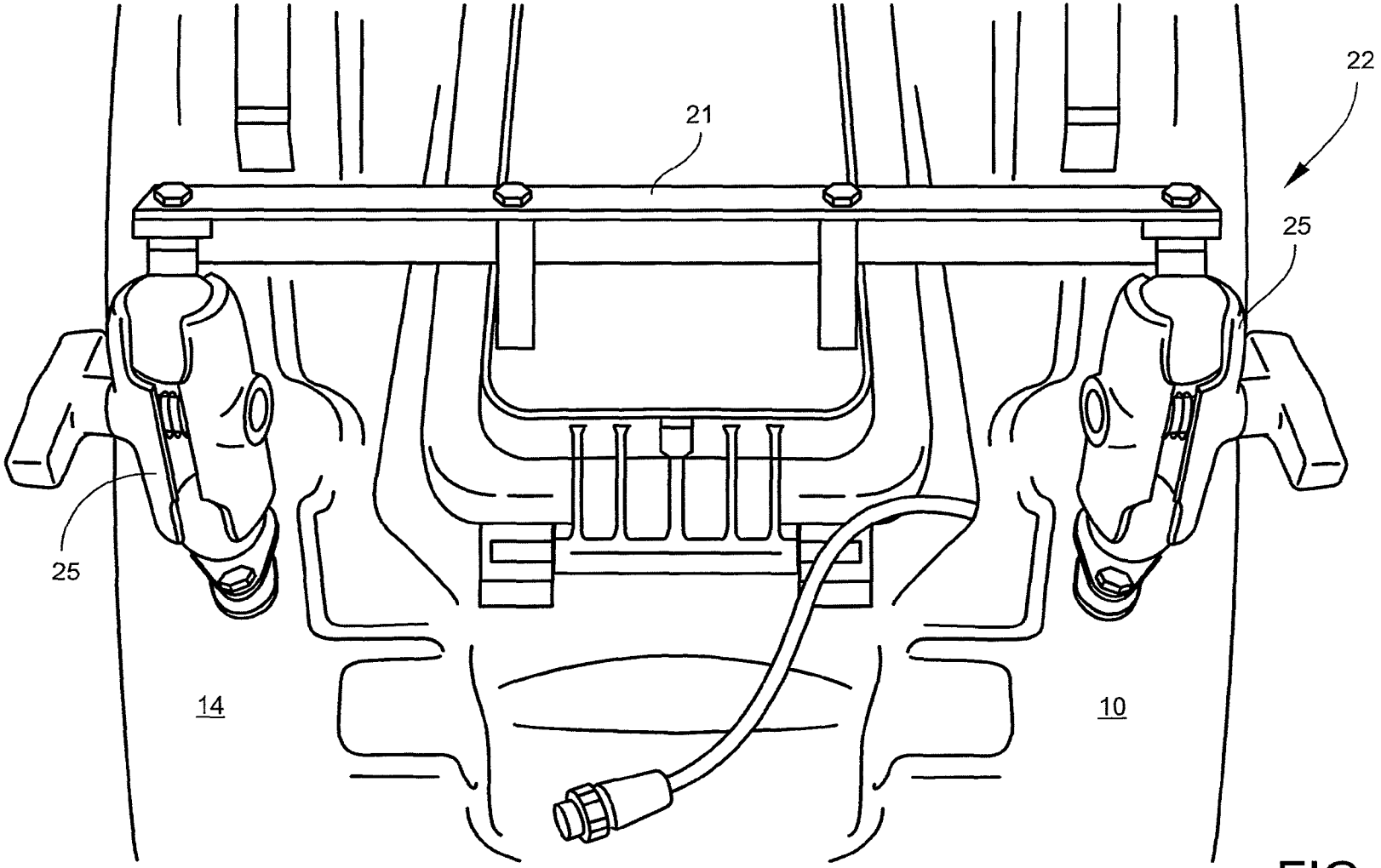
FIG. 5 is a view from the rear of the watercraft showing how the mounting system is joined with the watercraft

Referring to the drawings wherein like numerals indicate like elements, there is shown in FIG. 1, a watercraft 10 having a bow 12, stern 14, and a cockpit 16. In this embodiment, the trolling motor system 20 is affixed to the stern. The watercraft may be any light-weight watercraft, but it may be a kayak or canoe. If a kayak, it may be a single or tandem kayak with or without an open top.

The motor system 20 generally includes: a mounting system 22; a winch 30; a guidance mechanism 32; and a motor 34.

The mounting system 22 is attached to the watercraft. The mounting system 22 connects the motor, winch, and guidance system to the watercraft. The mounting system allows, when attached to the watercraft and the winch is rigidly affixed (e.g. versus the wire used with the electrical winch shown in U.S. Pat. No. 9,290,251) to the moveable end of the plate, the motor system to "bounce" (e.g., flex up and down), for example, when the a part of the motor system strikes a submerged object. The mounting system also facilitates the placement and removal of the motor system on the watercraft.

The mounting system 22 generally includes a bracket 21 and a plate 23, see FIGS. 2-5. The bracket 21 includes a connector 25 that removably joins the bracket to the watercraft. The plate 23 includes a first end 24, a moveable end 26, a hinge 28 therebetween. A pivot 27 connects the bracket 21 to the first end 24 of the plate 23 and allows the motor system to bounce. The moveable end 26 extends away from the stern 14 and hangs outside watercraft 10. Hinge 28 allows the movement of the moveable end (as will be discussed in greater detail below). The fixed end may include a stop 29 to prevent the downward movement of the moveable end 26 beyond a predetermined position (e.g., a horizontal plane).

The connector 25 may be any connector. The connector facilitates a universal connection between any style watercraft and the motor system. The connector allows movement between the bracket and the watercraft in multiple planes. In one embodiment, the connector 25 is a double ball joint. One ball (or a pair of balls) is affixed to the watercraft, the other ball (or pair of balls) is affixed to the bracket, and a socket (or clamp) interconnects the watercraft ball to the bracket ball. In other embodiments, the connector may be made of screw, bolts, clevis pins or the like.

Winch 30 may be mounted to (or affixed on) the fixed end 24 and thereby may be mounted on the stern 14. Winch 30 may be any device that is capable of raising and lowering, in a controlled manner, the distal end of the moveable end 26. Winch 30 may be: an electrical winch; a linear actuator, e.g., worm gear device; and/or hydraulic actuator. Winch 30 is coupled to a distal end of the moveable end 26, so that the winch may raise and lower the moveable end 26 between an upper and lower position, see generally FIGS. 6-8. In the embodiment, the winch is directly coupled with the moveable end (i.e., no intervening pulleys or linkages between the winch and moveable end). Springs (e.g., coil springs), not shown, interconnecting (i.e., spanning across the hinge) the fixed end and moveable end may be used to lessen shock during and/or facilitate movement between the up and down position. If the winch 30 is the actuator (linear or hydraulic), the coupling of the moveable end 26 of the plate to the free (or moveable) end of the actuator may prevent movement of the hinge 28; so pivot 27 allows the motor system to bounce. Operation of the winch may be controlled by a switch located at the winch or remotely from the cockpit.

Figure 10:
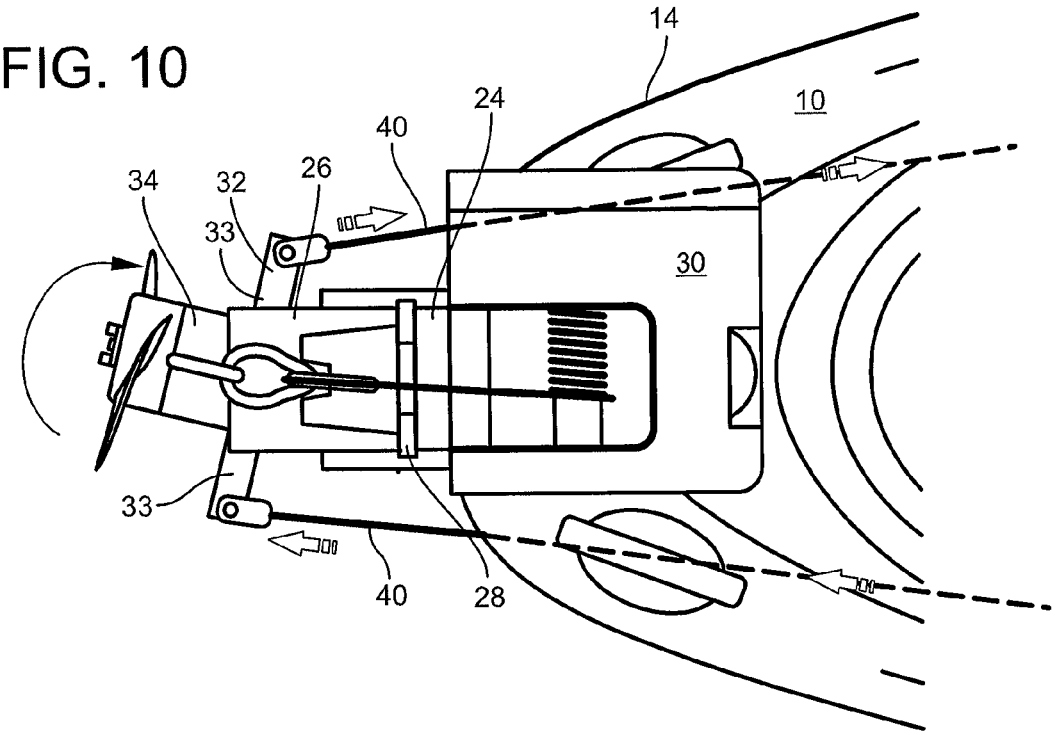
FIG. 10 is a partial view of the watercraft with the motor system where the motor is angled for port (left) movement.
Figure 11:
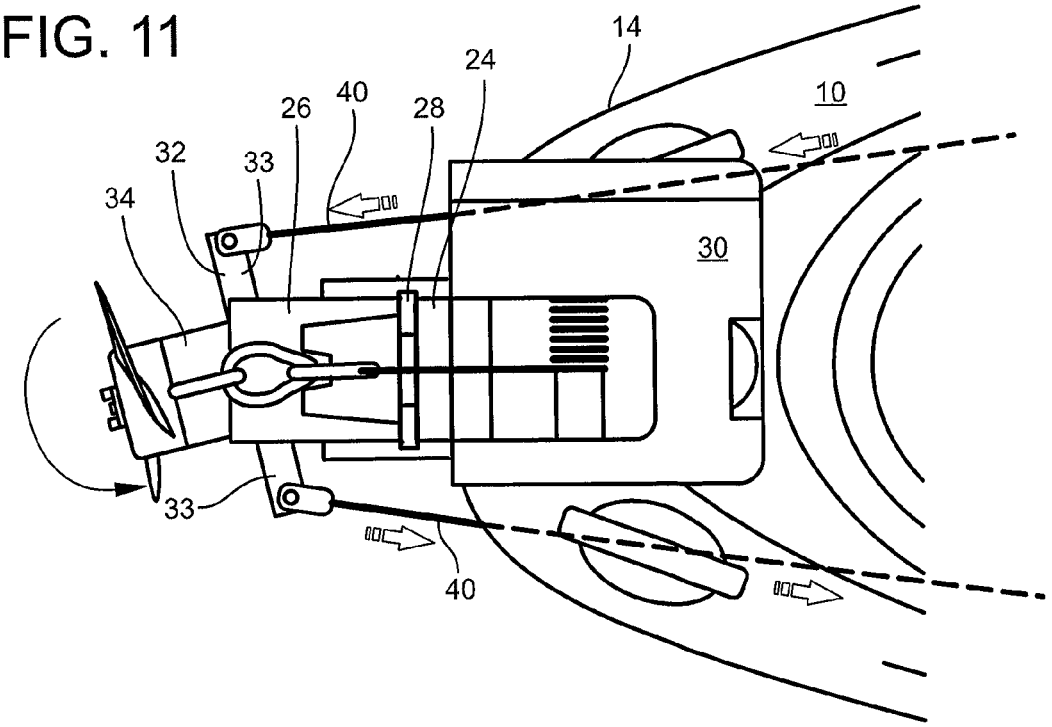
FIG. 11 is a partial view of the watercraft with the motor system where the motor is angled for starboard (right) movement.
Figure 12:
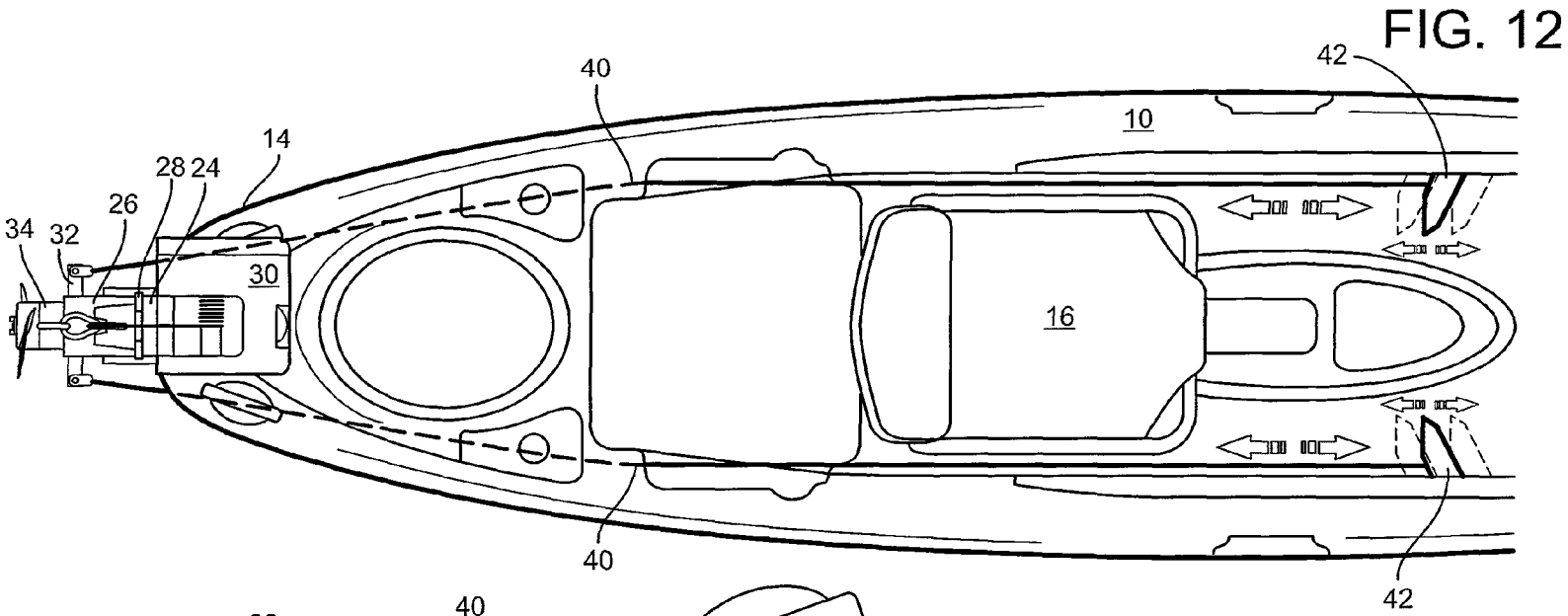
FIG. 12 is a partial view of the watercraft with the motor system where an embodiment of the steering mechanism for the guidance mechanism is illustrated.
Figure 13:
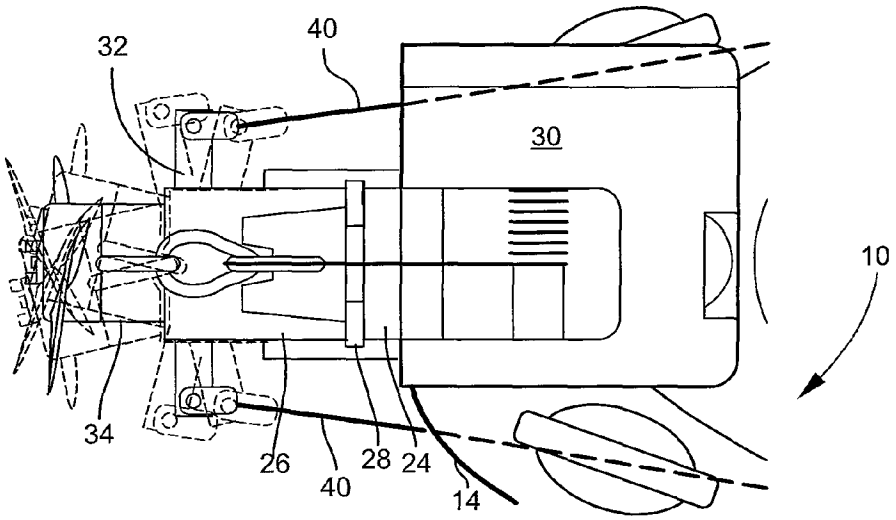
FIG. 13 is a partial view of the watercraft with the motor system where rotational movement of the guidance mechanism is illustrated.

Guidance mechanism 32 may be mounted to and below moveable end 26. Guidance mechanism 32 is rotationally affixed to the moveable plate 26, so that it may swing back and forth (oscillate) in a horizontal plane, see FIGS. 9-12. This movement may be about a pivot point, for example, pivot 44 and bracket 48, see FIG. 14. Guidance mechanism 32 may include a pair of laterally extending wings 33, see FIGS. 9-11. Wings 33 are aligned with pivot 44. Wings 33 are coupled to steering mechanism.

The steering mechanism may be any steering mechanism, for example, pedal operated (discussed below), joystick, rack and pinion, steering wheel, power-assisted, and the like. In the embodiment shown, the steering mechanism allows the user to forward (i.e., without any body twist or reaching backward during steering). As shown, the steering mechanism may include a wire guidance mechanism 40. Wires 40 connect the wings 33 to the cockpit from where the user steers the watercraft. These wires 40, in one embodiment, may extend within the hull of the watercraft (note the phantom lines, for example see FIGS. 9-13). As shown, the steering mechanism may, for example, include a pair of pedals 42 (for example, running in a horizontal track within the watercraft), but the steering mechanism is not so limited. With the pedals 42, the user steers the watercraft with their feet, see FIGS. 12 and 9-11.

Motor 34 may be affixed to and below and moves with the guidance mechanism 32 (as a single unit, i.e., when the guidance mechanism moves the motor moves). In the embodiment shown, motor 34 may be spaced below guidance mechanism 32 with a vertical plate (or rudder) 35. Motor 34, when in the down position, see FIG. 8, is submerged below the water line. Motor 34 may be an electric motor. Motor 34 may be a variable speed motor. Motor 34 may be reversible. Motor 34 includes a propeller. The propeller may be directly coupled to the motor (i.e., direct drive or with no linkage nor transmission between the motor and propeller).

A quick release mechanism 38 may couple the moveable plate 26 to the guidance mechanism 32 and motor 34. Quick release mechanism 38, one embodiment shown in exploded view in FIG. 14, generally includes pivot 44. Pivot 44 may be a threaded rod with a knob 46 at one end. As shown, bracket 48 may be a part of the guidance mechanism 32 (which may also be the rotational pivot for the guidance mechanism discussed above). Pivot 44 may be engaged with moveable end 26 via the bracket 48, is inserted into bracket 48, and is held in place by threading pivot 44 into vertical plate 35. Removal of pivot 44 from plate 35 allows the guidance mechanism 32 and motor 34 to be disengaged from motor system 20 for easy launch and removal of the watercraft from the water.

Skeg 60, see FIG. 1, is affixed at the bottom side of the motor. Skeg 60 a device that is intended to take a striking force between the motor system and a submerged obstruction.

A source of electricity 36 may be provided. Electricity source 36 may be any marine battery. The electrical source may be operatively connected to the winch and/or motor by any conventional means. As shown, FIG. 14, cord 50 interconnects the electrical source 36 to the motor 34, the cord 50 may run through opening 52 of the hull. The electrical may be located anywhere within or on the watercraft 10. Source 36 may be located aft of the cockpit 16 (i.e., the stern) within the watercraft (i.e. below a hatch). The source 36, however, may be located in the bow or between the bow and the stern, or in a battery box located behind the cockpit on the top of the hull.

Figure 6:
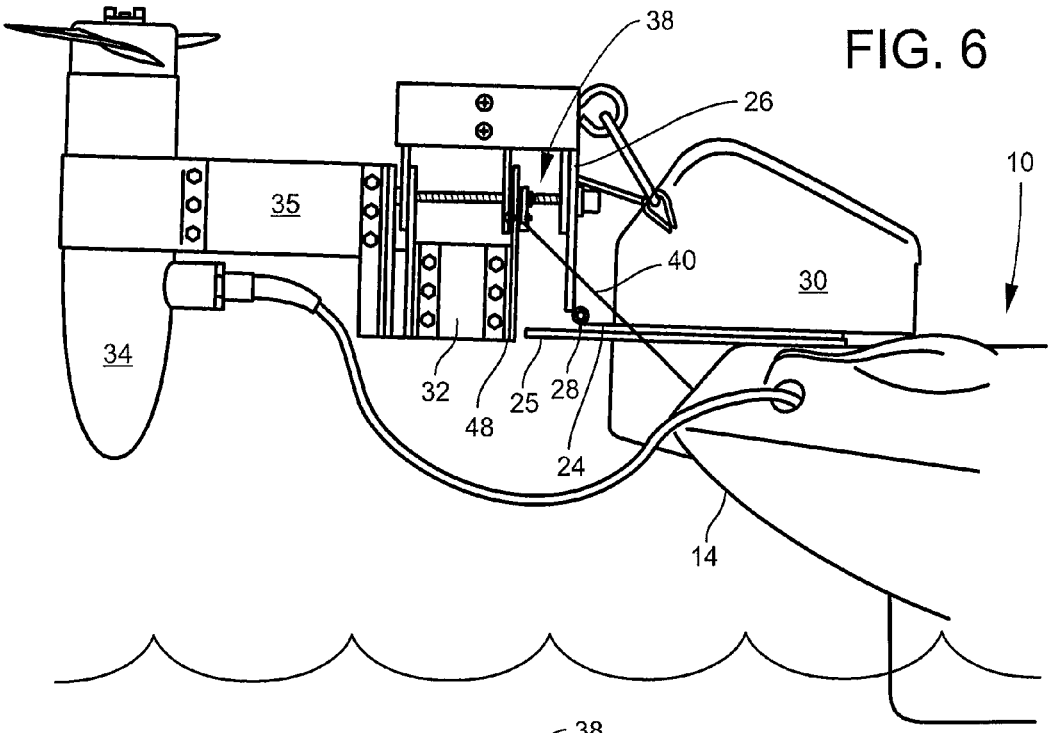
FIG. 6 is a partial view of the watercraft with the motor system in an up position.
Figure 7:
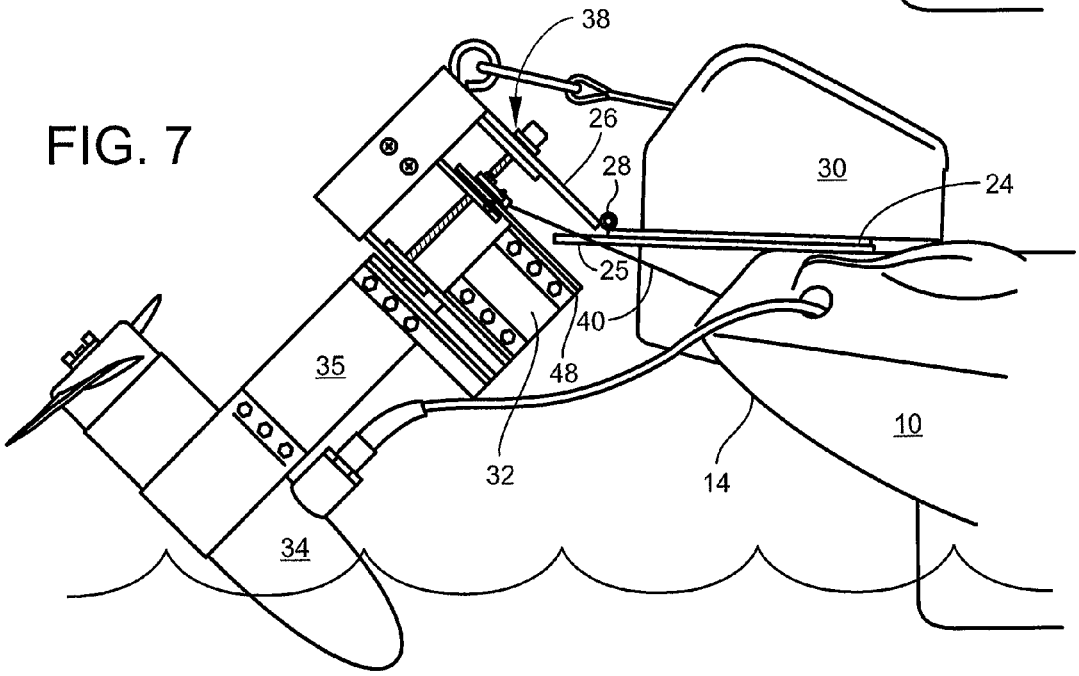
FIG. 7 is a partial view of the watercraft with the motor system in an mid-raised position.
Figure 14:
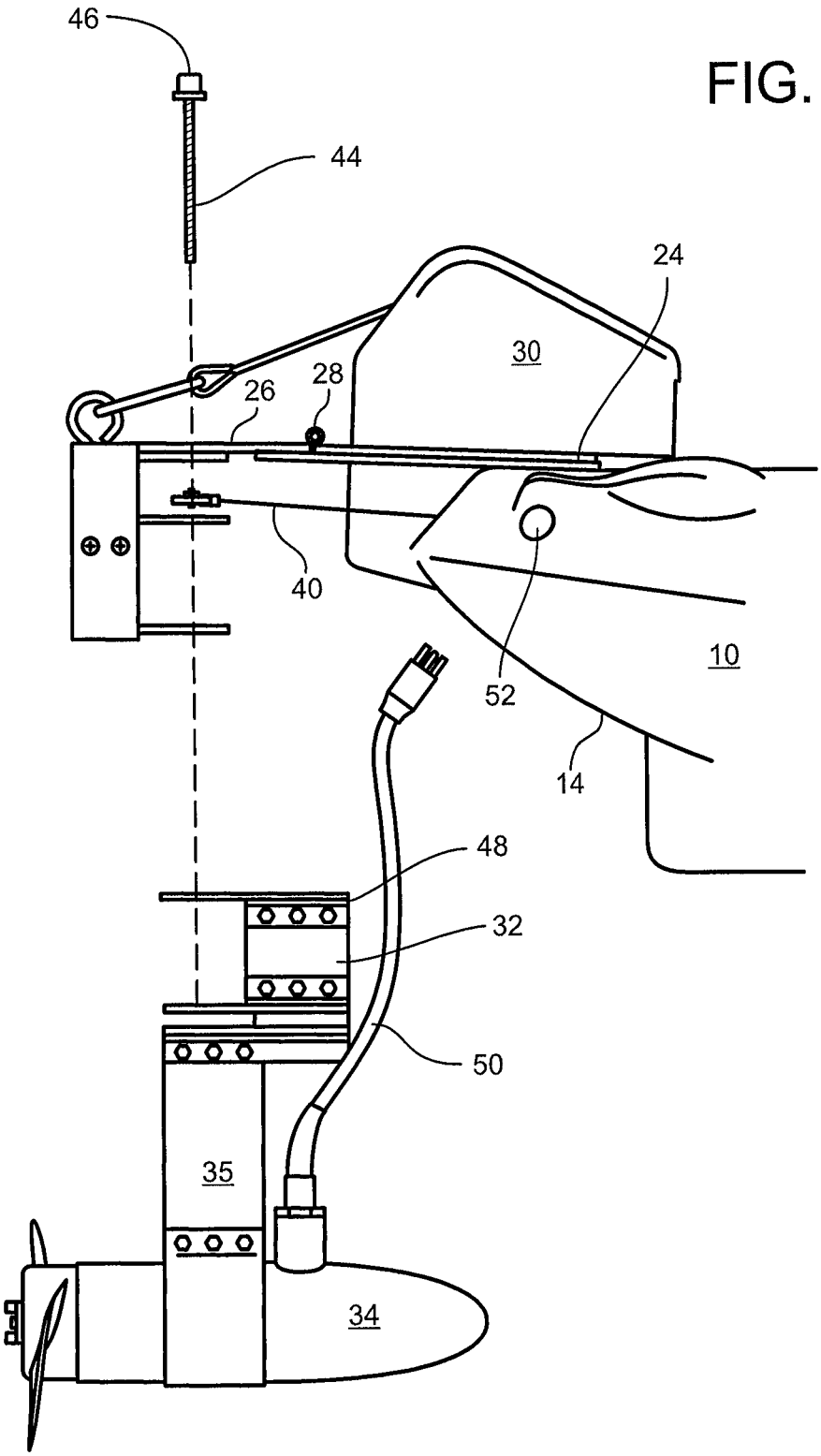
FIG. 14 is a partial view of the watercraft with the motor system where an embodiment of the quick release mechanism is illustrated.

In operation, see FIGS. 6-8, the winch may be used to raise and lower the motor system between an up position (FIG. 6), a down position (FIG. 8) and a mid position (FIG. 7). In FIGS. 9-13, the operation of the guidance mechanism 32 is illustrated as controlled by the steering mechanism. In FIG. 14, the operation of the quick release mechanism 38 is illustrated.

The motor system 20 may be made of any material, but in one embodiment the structural parts, (e.g., plate and brackets),may be made of light-weight and/or non-corroding materials, such as aluminum, plastic, and/or fiber reinforced composite, and combinations thereof.

The present invention may be embodied in other forms without departing from the spirit and the essential attributes thereof, and, accordingly, reference should be made to the appended claims, rather than to the foregoing specification, as indicating the scope of the invention.

I claim:

1. A trolling motor system for a light-weight watercraft comprises:

a mounting system attaches to the watercraft, the mounting system includes a bracket and a plate, the plate includes a first end, a moveable end, and a hinge therebetween, a connector removably joins the bracket to the watercraft, a pivot connects the bracket to the first end of the plate;

a winch is located adjacent the first end and is adapted to raise and lower the movable end between an up position and a down position;

a guidance mechanism is coupled to and below the moveable end, the guidance mechanism includes a wire system for controlling rotational movement of the trolling motor; and a trolling motor affixed to and located below the guidance mechanism.

2. The system according to claim 1 further comprising a quick release mechanism coupling the guidance mechanism and trolling motor to the moveable end.

3. The system according to claim 2 wherein the quick release mechanism comprises a removable pin that releasably fastens the guidance mechanism and trolling motor to the moveable end.

4. The system according to claim 1 further comprising a skeg affixed below the motor.

5. The system according to claim 1 wherein the guidance mechanism further comprises a steering mechanism within a cockpit of the watercraft.

6. The system according to claim 5 wherein the steering mechanism further comprises a pair of pedals for moving the guidance mechanism.

7. The system according to claim 1 wherein the trolling motor is an electric motor.

8. The system according to claim 1 further comprising a source of electricity operatively associated with the winch and the motor.

9. The system according to claim 8 wherein the source of electricity is a battery.

10. The system according to claim 8 wherein the source of electricity is located in the stern, or bow, or therebetween, or behind a cockpit of the watercraft.

11. A trolling motor system for a watercraft having a stern and a cockpit comprises:

a mounting system attaches to the watercraft, the mounting system includes a bracket, a plate and a stop, the plate includes a first end, a moveable end, and a hinge therebetween, a connector removably joins the bracket to the watercraft, a second pivot connects the bracket to the first end of the plate, the stop prevents movement of the moveable end beyond a predetermined position;

a winch is mounted on the first end and is adapted to raise and lower the movable end between an up position and a down position, the winch is directly and releasably coupled to the moveable end;

a guidance mechanism is rotationally and releasably coupled to and below the moveable end, and includes a steering mechanism which is operable from the cockpit;

an electric trolling motor affixed to and located below the guidance mechanism via a rudder; and a skeg affixed below the motor.

* * * * *